US008823483B2

(12) United States Patent
Smith et al.

(10) Patent No.: US 8,823,483 B2
(45) Date of Patent: Sep. 2, 2014

(54) POWER RESISTOR WITH INTEGRATED HEAT SPREADER

(71) Applicants: Clark Smith, Columbus, NE (US); Todd Wyatt, Columbus, NE (US)

(72) Inventors: Clark Smith, Columbus, NE (US); Todd Wyatt, Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 112 days.

(21) Appl. No.: 13/725,018

(22) Filed: Dec. 21, 2012

(65) Prior Publication Data

US 2014/0176294 A1 Jun. 26, 2014

(51) Int. Cl.
*H01C 1/14* (2006.01)

(52) U.S. Cl.
USPC ..... 338/332; 338/51; 338/333

(58) Field of Classification Search
USPC ..... 338/322, 51, 333
See application file for complete search history.

(56) References Cited

U.S. PATENT DOCUMENTS

| | | | | |
|---|---|---|---|---|
| 5,179,366 | A * | 1/1993 | Wagner | 338/313 |
| 5,473,510 | A * | 12/1995 | Dozier, II | 361/719 |
| 5,481,241 | A * | 1/1996 | Caddock, Jr. | 338/51 |
| 5,563,570 | A * | 10/1996 | Lee | 338/50 |
| 5,604,477 | A | 2/1997 | Rainer et al. | |
| 5,945,905 | A * | 8/1999 | Mazzochette | 338/51 |
| 5,999,085 | A | 12/1999 | Szwarc et al. | |
| 6,859,999 | B2 | 3/2005 | Huber et al. | |
| 6,925,704 | B1 | 8/2005 | Schneekloth et al. | |
| 7,038,572 | B2 | 5/2006 | Huber et al. | |
| 7,042,328 | B2 | 5/2006 | Schneekloth et al. | |
| 7,102,484 | B2 | 9/2006 | Schneekloth et al. | |
| 7,190,252 | B2 | 3/2007 | Smith et al. | |
| RE39,660 | E | 5/2007 | Szwarc et al. | |
| 2011/0156860 | A1 | 6/2011 | Smith et al. | |

* cited by examiner

*Primary Examiner* — Kyung Lee
(74) *Attorney, Agent, or Firm* — Volpe and Koenig, P.C.

(57) ABSTRACT

An integrated assembly includes a resistor and a heat spreader. The resistor includes a resistive element and terminals. The heat spreader is integrated with the resistor and includes a heat sink of thermally conducting and electrically insulating material and terminations of a thermally conducting material and situated at an edge of the heat sink. At least a portion of a top surface of the resistive element is in thermally conductive contact with the heat sink. Each resistor terminal is in thermally conductive contact with a corresponding termination of the heat sink. A method of fabricating an integrated assembly of a resistor and a heat spreader includes forming the heat spreader, forming the resistor, and joining the heat spreader to the resistor by bonding at least a portion of a top surface of the resistive element to the heat sink and bonding each electrically conducting terminal to a corresponding termination.

26 Claims, 3 Drawing Sheets

POWER RESISTOR WITH INTEGRATED HEAT SPREADER

FIELD OF INVENTION

This application is in the field of electronic components and, more specifically, resistors.

BACKGROUND

The performance of certain electrical resistors can be degraded by elevated temperatures. The resistance may significantly change, thereby adversely affecting a circuit in which the resistor functions. The temperature of a resistor may rise due to heat from the environment or due to heat generated in the resistor itself as it dissipates electrical power. To reduce operating temperatures, a resistor may be attached to a heat spreader that helps carry heat away from the resistor. There is a need to carry the heat away as efficiently as possible if reduced operating temperatures are desired.

SUMMARY

An integrated assembly comprises a resistor and a heat spreader. The resistor comprises a resistive element having a top surface and terminals in electrical contact with the resistive element. The heat spreader is integrated with the resistor and comprises a heat sink comprising a piece of thermally conducting and electrically insulating material, and terminations comprised of a thermally conducting material and situated at an edge of the heat sink. At least a portion of the top surface of the resistive element is in thermally conductive contact with the heat sink. Each terminal is in thermally conductive contact with a corresponding one of the terminations.

A method of fabricating an integrated assembly of a resistor and a heat spreader comprises forming the heat spreader by fabricating thermally conducting terminations on a thermally conducting and electrically insulating heat sink, wherein the heat sink and the terminations are in thermally conducting contact with one another; forming a resistor by fabricating electrically conducting terminals in electrical contact with a resistive element; joining the heat spreader to the resistor by bonding at least a portion of a top surface of the resistive element to the heat sink to form thermally conductive contact between the resistive element and the heat sink; and bonding each of the electrically conducting terminals to a corresponding one of the terminations to form thermally and electrically conductive contact between the terminals and the terminations.

DETAILED DESCRIPTION OF THE EMBODIMENTS

Figure 1:
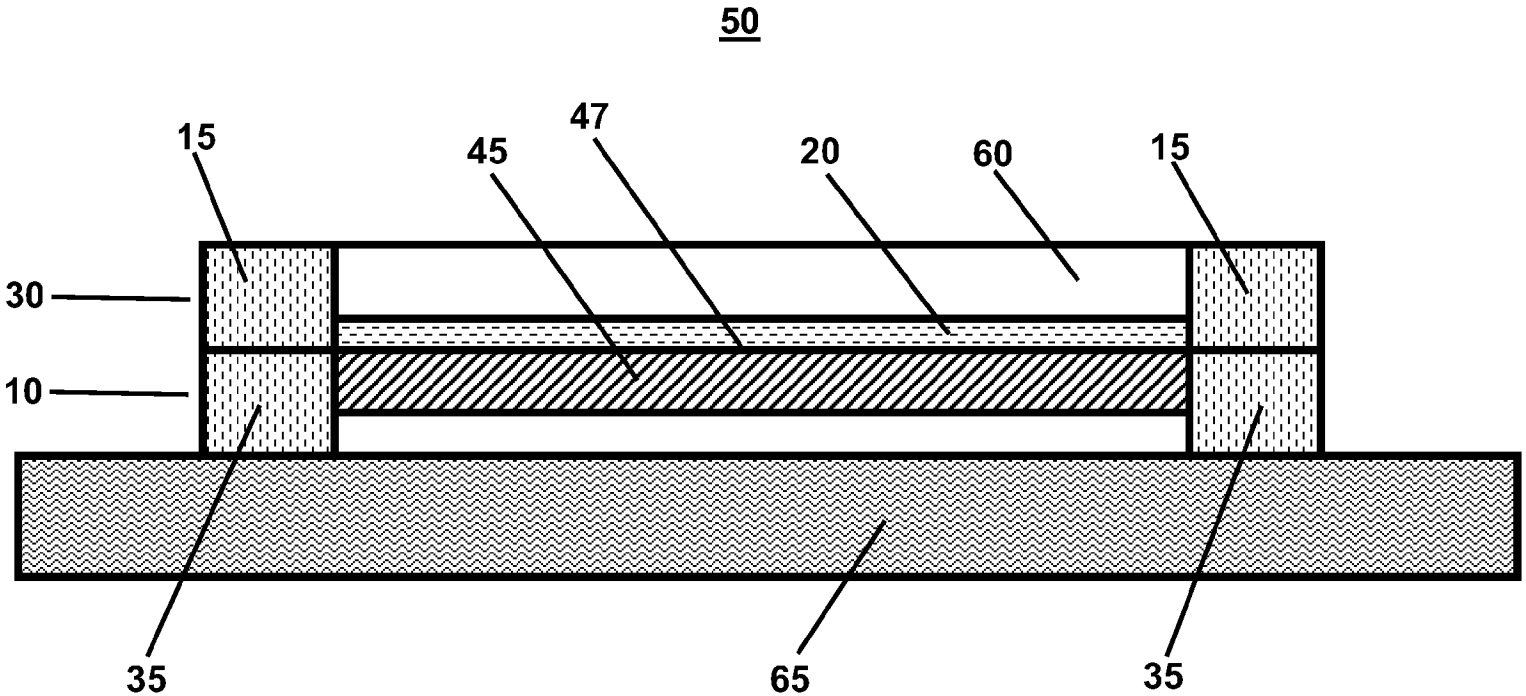
FIG. 1 shows a cross-section of an embodiment of an integrated assembly of a resistor and a heat spreader.

FIG. 1 shows a side view cross-section of an embodiment of an integrated assembly 50 of a resistor 10 and a heat spreader 30 mounted to a printed circuit board or other mounting surface 65. Assembly 50 may be suitable for use as a resistor in an automobile, computer server, or other high power applications, but it is not limited to those uses.

Resistor 10 includes resistive element 45 having a top surface 47 and electrically conducting terminals 35 in electrical contact with resistive element 45. Terminals 35 may also be thermally conducting. Resistive element 45 may be coated with a coating material (not shown) to protect resistive element 45 during plating of terminals 35 and terminations 15, as described below. The coating material prevents resistive element 45 from accepting plating. The coating material could be any electrically insulative material such as a paint, an epoxy, or a silicone epoxy material. The coating material may be on all faces of resistive element 45 not covered by heat spreader 30. The coating material may be applied by spraying, printing, roll coating, or any other generally accepted method of applying similar coating materials. It may also be deposited by such methods as sputtering or chemical vapor deposition. In an embodiment, terminals 35 may be straight in all dimensions, with no bends, thus simplifying manufacturing compared to other structures requiring bending. Each terminal 35 may be made from an unbent piece of metal attached to resistive element 45. Alternatively, terminals 35 may be deposited, thereby also avoiding a need for bending. Terminals 35 could be deposited through plating or other additive process where materials with higher electrical and thermal conductivities may be added. Materials that may be used by themselves or in combinations of layers include, but are not limited to, copper, nickel or tin solders. Terminals 35 may be in any combination of electrical contact, thermal contact, and mechanical contact with mounting surface 65.

Heat spreader 30 includes a heat sink 60 and terminations 15. Heat sink 60 may be fabricated from a piece of highly thermally conducting and electrically insulating material, such as a ceramic or a passivated metal. Terminations 15 may be fabricated from a highly thermally conducting material such as a metal. Terminations 15 may also be highly electrically conducting. In an embodiment, terminations 15 may be situated at edges of heat sink 60 as shown in FIG. 1.

Heat spreader 30 and resistor 10 are bonded to each other to form a thermally highly conducting path from resistor 10 to heat spreader 30. This thermally conducting path allows resistor 10 to operate at increased power while keeping the temperature lower to avoid degradation in physical structure or in resistance value, since heat generated in resistor 10 is efficiently conducted away and dissipated by heat spreader 30. In an embodiment as shown in FIG. 1, resistive element 45 may be bonded to heat sink 60 with a thermally conducting and electrically insulating adhesive 20 between resistive element 45 and heat sink 60. In an embodiment, at least a portion of top surface 47 of resistive element 45 may be in thermally conductive contact with heat sink 60. In an embodiment, the entirety of top surface 47 of resistive element 45 may be in thermally conductive contact with heat sink 60. In an embodiment, adhesive 20 may not extend over terminals 35 and may not extend over terminations 15, as shown in FIG. 1.

Furthermore, each resistor terminal 35 may be highly thermally conducting and in high thermally conducting contact with a corresponding heat sink termination 15. Resistor terminal 35 and heat sink termination 15 may be joined by solder or an adhesive that may be thermally conducting, electrically conducting, or both. The connection between resistor terminal 35 and heat sink termination 15 provides an additional thermally conducting path for heat energy to flow from heat spreader 30 into terminals 35 and then to mounting surface 65. This may be accomplished with heat sink 60 being an electrical insulator and therefore not shorting resistive element 45.

Figure 2B:
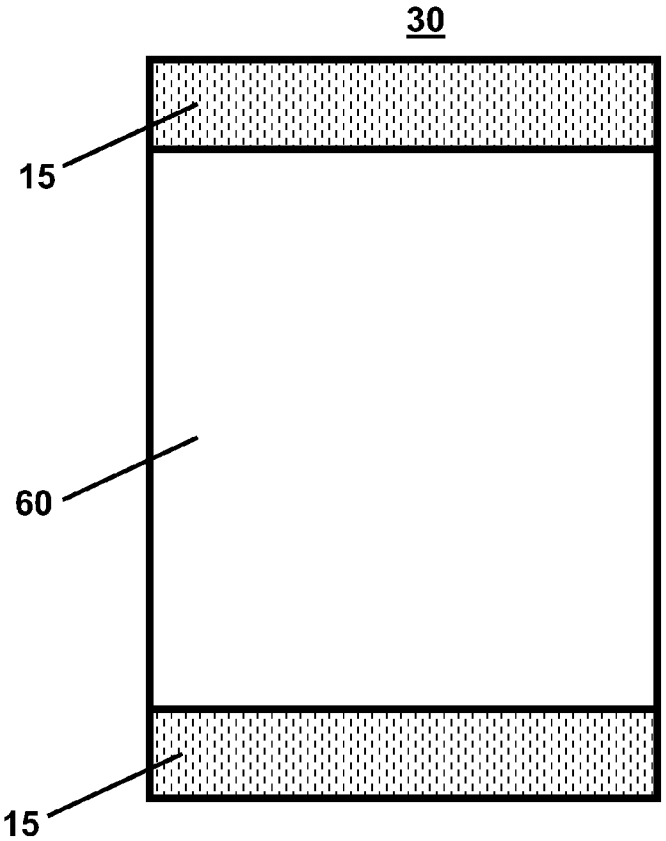
FIGS. 2*a* and 2*b* show plan views of a resistor and a heat spreader, respectively.
Figure 2A:
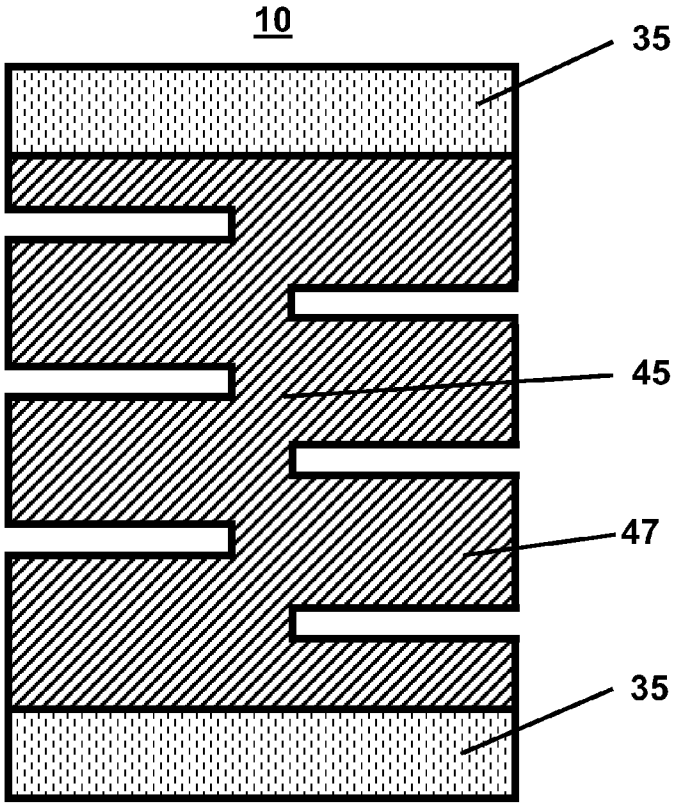

FIGS. 2*a* and 2*b* show, respectively, plan views of an embodiment of resistor 10 and of heat spreader 30, before being bonded to each other. FIG. 2*a* shows a top view of resistor 10, while FIG. 2*b* shows a bottom view of heat spreader 30. Fill patterns and guide numbers correspond to various structural features shown in FIG. 1, namely resistive element 45, resistor terminals 35, resistive element top surface 47, heat sink 60 and heat sink terminations 15.

Heat sink 60 may be composed of a ceramic. The ceramic may be thermally conducting and electrically insulating ceramic, such as alumina ($Al_2O_3$), aluminum nitride (AlN) beryllia (BeO). Heat sink 60 may be composed of a metallic material, such as insulated metal substrate (IMS), electrically passivated metal, or electrically unpassivated metal. With such metallic heat sinks 60, terminations 15 and resistive element 45 should be electrically isolated from heat sink 60, and terminations 15 should be electrically isolated from each other to prevent resistive element 45 from being shorted. If metallic, heat sink 60 may be isolated from resistive element 45 with a passivation or with adhesive 20. Heat sink terminations 15 may be composed of a metal. In an embodiment, heat sink terminations 15 may be situated only on a front surface of heat sink 60 that is in thermally conductive contact with resistive element 45. Alternatively, heat sink terminations 15 may additionally wrap around onto at least one of an edge surface of heat sink 60 and a back surface of heat sink 60 opposite the front surface. In yet another alternative, heat sink terminations 15 may be situated only on an edge surface of heat sink 60, as shown in FIG. 1.

Resistive element 45 may be a metal strip resistive element, but is not limited to being of this type. Thin film, thick film or metal foil may also be used to form resistive element 45 in their respective carrier materials. In an embodiment as shown in FIGS. 2*a* and 2*b*, the entirety of top surface 47 of resistive element 45 is in thermally conductive contact with heat sink 60. In an embodiment, a portion of top surface 47 of resistive element 45, less than the entirety of top surface 47, may be in thermally conductive contact with heat sink 60.

Terminals 35 and terminations 15 may be connected electrically as well as thermally. This feature provides relatively higher and more efficient heat transfer from resistor 10 to heat spreader 30 compared to prior structures in which a metallic electrical connection is not made between terminations and terminals.

Figure 3:
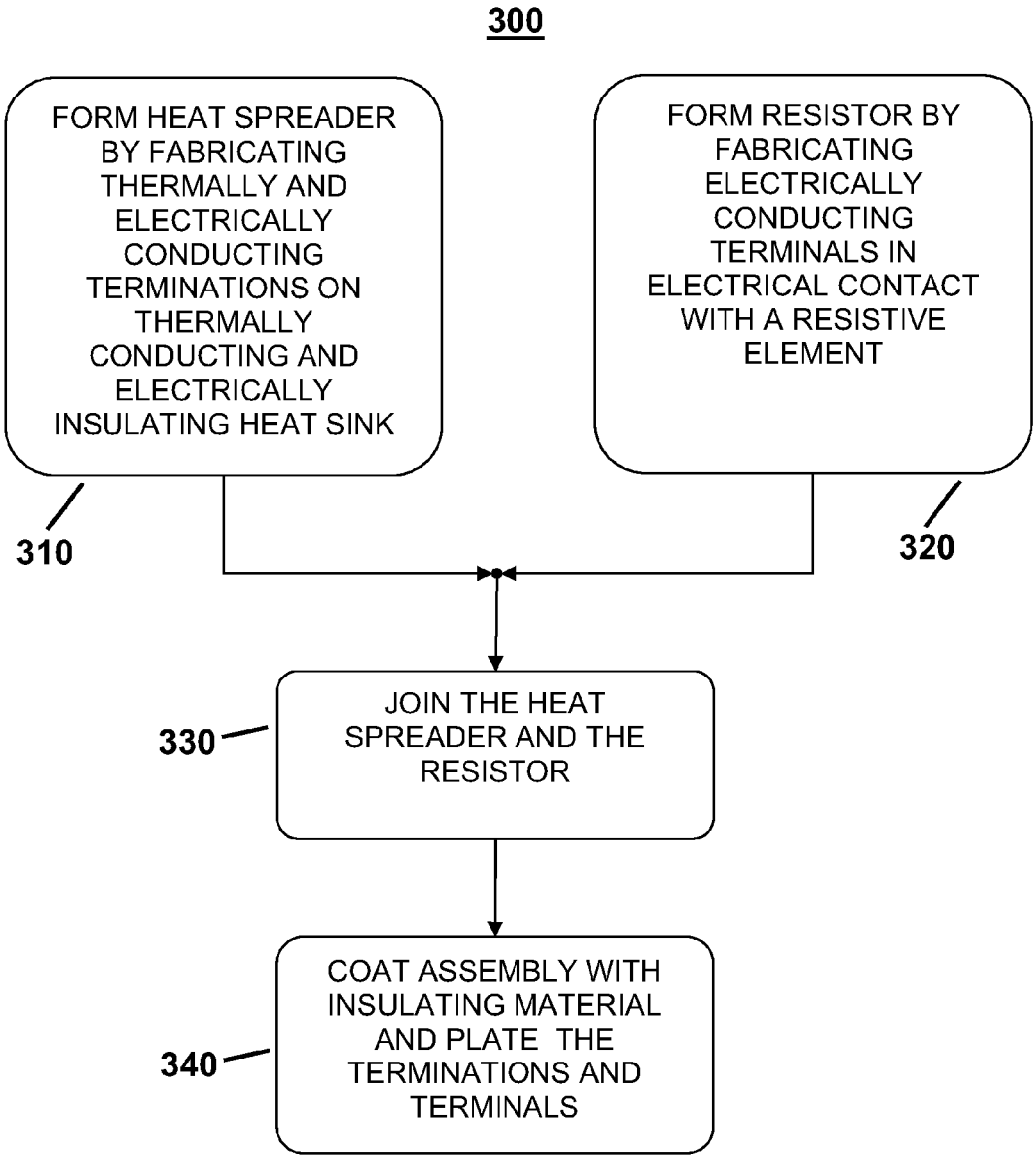
FIG. 3 shows an embodiment of a method of fabricating an integrated assembly of a resistor and a heat spreader.

FIG. 3 shows an embodiment of a method 300 of fabricating an integrated assembly of a resistor and a heat spreader. The order of carrying out various steps in the method 300 is not necessarily limited by FIG. 3, the following description, and the following claims. The order of certain steps may be changed, as will be understood by a person of ordinary skill in the art.

A heat spreader may be formed by fabricating thermally and electrically conducting terminations on a thermally conducting and electrically insulating heat sink 310. The heat sink and the terminations are in thermally conducting contact with one another.

A resistor may be formed by fabricating electrically conducting terminals in electrical contact with a resistive element 320. An electrically conductive terminal may be fabricated by attaching unbent pieces of metal to the resistive element. Alternatively, an electrically conductive terminal may be fabricated by depositing an electrically conducting material on the resistive element. Both of these methods of fabricating electrically conducting terminals avoid having to bend metal pieces, as in prior assemblies, which may be a more costly process and more difficult to manufacture.

The heat spreader and the resistor are joined 330 to make the integrated assembly. In an embodiment, the heat spreader and resistor may be joined by bonding either a portion of, or the entirety of, a top surface of the resistive element to the heat sink to form thermally conductive contact between the resistive element and the heat sink and, in addition, bonding each of the electrically conducting terminals to a corresponding one of the terminations to form thermally conductive contact between the terminals and the terminations. In an embodiment, referring to FIGS. 1, 2*a* and 2*b*, this joining can be done using an electrically conductive and thermally conductive ink deposited on the top of resistor terminals 35 during the joining process that utilizes thermally conducting and electrically insulating adhesive 20. Alternatively, the mentioned ink could be placed in a continuous layer on vertical faces of resistor terminals 35 and terminations 15 of heat spreader 30 after joining resistor 10 and heat spreader 30. Yet another alternative method may include a weld between resistor terminals 35 and heat sink terminations 15 of heat spreader 30 in conjunction with or after the joining of resistor 10 and heat spreader 30.

In an embodiment of the method of FIG. 3, terminations 15 may be formed only on edge surfaces of heat sink 60, as shown in FIG. 1. Terminations may be fabricated with a thick film deposition process, a thin film deposition process, or a plating process, all of which are known to a person of ordinary skill in the art. Suitable materials for terminations include, but not limited to, copper, nickel, nickel alloys, tin, or tin alloys. Bonding of either a portion of, or the entirety of, the top surface of the resistive element to the heat sink may be done with a thermally conducting, electrically insulating adhesive such as Bergquist Liquibond 2000. In an embodiment, resistor terminals and heat sink terminations may be both metallic. Bonding of resistor terminals to heat sink terminations may be done with either solder or an electrically conductive adhesive. In that case the contact between the terminals and terminations may be made both thermally and electrically conducting.

After the heat spreader and resistor are joined they may be coated with an insulating material and the terminals and terminations may be plated 340. In an embodiment, the outsides of the resistor terminals and heat sink terminations may be plated with a metallic layer such as nickel. Solder may also be applied to the outsides of the terminals and terminations. An electroplating process may be used to apply the metallic layer and the solder. The metallic plating layer may further strengthen the mechanical bond between the resistor and the heat spreader and increase the thermal conductivity because of the additional metal thickness added to the terminations and terminals.

Table 1 shows results of hot spot testing on three resistor/heat spreader assemblies as described hereinbefore. Also shown are results for a resistor with no heat spreader for comparison. The resistor is the same in each case.

TABLE 1

| Col. 1 Heat Sink Construction (Power Applied) | Col. 2 Hot Spot Temperature | Col. 3 Temperature Rise | Col. 4 Terminal Temperature | Col. 5 $R_{th}$ |
|---|---|---|---|---|
| Prior art, no heat spreading (1 W) | 199° C. | 174° C./W | 46° C. | 153° K/W |
| $Al_2O_3$ (3 W) | 193° C. | 56° C./W | 96° C. | 32° K/W |
| AlN (3 W) | 151° C. | 42° C./W | 92° C. | 20° K/W |

TABLE 1-continued

| Col. 1 Heat Sink Construction (Power Applied) | Col. 2 Hot Spot Temperature | Col. 3 Temperature Rise | Col. 4 Terminal Temperature | Col. 5 $R_{th}$ |
|---|---|---|---|---|
| AlN (4 W) | 195° C. | 42.5° C./W | 113° C. | 21° K/W |

Table 1 presents data showing an increase in thermal efficiency obtained with structures disclosed herein. Data in Table 1 was gathered by powering assemblies of various constructions to a given power as shown in Column 1. Temperature of a hottest area of the resistor, determined with an infrared camera, is shown in Column 2, Hot Spot Temperature. Column 3 of Table 1 shows the Temperature Rise attributable to the power applied to the resistor, and is equal to the Hot Spot temperature (HS), Column 2, less the ambient test temperature (Tamb), which was 25° C., divided by the power applied in watts (W), i.e. Temperature Rise=(HS−Tamb)/W. Column 4 of Table 1 shows the corresponding Terminal Temperature for the resistor under test. Column 5 shows Thermal Resistance, signified by $R_{th}$, which is a measure of thermal inefficiency. Thus the lower the $R_{th}$ number the greater the efficiency of the device to dissipate heat. Thermal resistance is calculated as the difference between Hot Spot (HS) in Column 2 and Terminal Temperature (TT) in Column 4 divided by the power in Watts (W) applied shown in Column 1, i.e. $R_{th}$=(HS−TT)/W. The data in Table 1 show that the decrease in thermal resistance from a prior art structure is a factor of 5 or greater, depending on the material used for the heat spreader.

Although specific terms and examples are employed in this specification and drawings, these are used in a generic and descriptive sense only and not for purposes of limitation. Terms such as "electrically conducting", "thermally conducting", and "electrically insulating" are to be understood in practical, relative terms as they would be understood by a person of ordinary skill in the art. As an example, a person of ordinary skill in the art would regard most metals as being both electrically and thermally conducting. A person of ordinary skill in the art will recognize that the terms "thick film process" and "thin film process" and similar terms refer to distinct classes of film deposition processes and not merely to relative thicknesses of a deposited film. Changes in the form and the proportion of parts as well as in the substitution of equivalents are contemplated as circumstances may suggest or render expedient without departing from the spirit or scope of the following claims.

What is claimed is:

1. An integrated assembly of a resistor and a heat spreader, comprising:

a resistor comprising:

a resistive element having a top surface; and terminals in electrical contact with the resistive element; and a heat spreader integrated with the resistor, the heat spreader comprising:

a heat sink comprising a piece of thermally conducting and electrically insulating material; and terminations comprised of a thermally conducting material and situated at an edge of the heat sink;

wherein at least a portion of the top surface of the resistive element is in thermally conductive contact with the heat sink; and each terminal is in thermally and electrically conductive contact with a corresponding one of the terminations.

2. The integrated assembly of claim 1 wherein at least one of the terminals is straight in all dimensions.

3. The integrated assembly of claim 1 wherein at least one of the terminals comprises a deposited electrically conducting material.

4. The integrated assembly of claim 1, further comprising a thermally conductive and electrically insulating adhesive between the heat sink and the resistive element.

5. The integrated assembly of claim 4, wherein the adhesive does not extend over the terminals and does not extend over the terminations.

6. The integrated assembly of claim 1, wherein the heat sink comprises a ceramic.

7. The integrated assembly of claim 6, wherein the ceramic comprises at least one of alumina, aluminum nitride, or beryllia.

8. The integrated assembly of claim 1, wherein the heat sink comprises a metallic material and the terminations are electrically isolated from the metallic material.

9. The integrated assembly of claim 8, wherein the metallic material comprises at least one of: insulated metal substrate, electrically passivated metal, or electrically unpassivated metal.

10. The integrated assembly of claim 1, wherein the terminations are situated only on a surface of the heat sink that is in thermally conductive contact with the resistive element.

11. The integrated assembly of claim 1, wherein the terminations are situated on a surface of the heat sink that is in thermally conductive contact with the resistive element and the terminations extend over an end surface and a back surface of the heat sink.

12. The integrated assembly of claim 1, wherein the terminations are situated only on an edge surface of the heat sink.

13. The integrated assembly of claim 1, wherein the resistive element is a metal strip resistive element.

14. The integrated assembly of claim 1, wherein the terminals and the terminations are both thermally and electrically conducting.

15. The integrated assembly of claim 1, wherein the terminals and the terminations are both metallic.

16. A method of fabricating an integrated assembly of a resistor and a heat spreader, comprising:

forming the heat spreader by fabricating thermally conducting terminations on a thermally conducting and electrically insulating heat sink, wherein the heat sink and the terminations are in thermally conducting contact with one another;

forming a resistor by fabricating electrically conducting terminals in electrical contact with a resistive element; and joining the heat spreader to the resistor by:

bonding at least a portion of a top surface of the resistive element to the heat sink to form thermally conductive contact between the resistive element and the heat sink; and bonding each of the electrically conducting terminals to a corresponding one of the terminations to form thermally and electrically conductive contact between the terminals and the terminations.

17. The method of claim 16, wherein the terminations are formed only on edge surfaces of the heat sink.

18. The method of claim 16, wherein the terminations are fabricated with a thick film process.

19. The method of claim 16, wherein fabricating electrically conducting terminals in electrical contact with a resistive element comprises attaching unbent pieces of metal to the resistive element.

20. The method of claim 16, wherein fabricating electrically conducting terminals in electrical contact with a resistive element comprises depositing an electrically conducting material on the resistive element.

21. The method of claim 16, wherein the bonding of at least a portion of the top surface of the resistive element to the heat sink is done with a thermally conducting, electrically insulating adhesive.

22. The method of claim 16, wherein the bonding of each of the electrically conducting terminals to a corresponding one of the terminations is done using at least one of solder or electrically conductive adhesive, thereby making both thermally and electrically conducting contact between the terminals and the terminations.

23. An integrated assembly of a resistor and a heat spreader, comprising:

a resistor comprising:

a resistive element having a top surface; and terminals in electrical contact with the resistive element; and a heat spreader integrated with the resistor, the heat spreader comprising:

a heat sink comprising a piece of thermally conducting and electrically insulating material; and terminations comprised of a thermally conducting material and situated at an edge of the heat sink;

wherein at least a portion of the top surface of the resistive element is in thermally conductive contact with the heat sink; and each terminal is in thermally conductive contact with a corresponding one of the terminations.

24. The integrated assembly of claim 23, wherein each terminal is in electrically conductive contact with a corresponding one of the terminations.

25. A method of fabricating an integrated assembly of a resistor and a heat spreader, comprising:

forming the heat spreader by fabricating thermally conducting terminations on a thermally conducting and electrically insulating heat sink, wherein the heat sink and the terminations are in thermally conducting contact with one another;

forming a resistor by fabricating electrically conducting terminals in electrical contact with a resistive element; and joining the heat spreader to the resistor by:

bonding at least a portion of a top surface of the resistive element to the heat sink to form thermally conductive contact between the resistive element and the heat sink; and bonding each of the electrically conducting terminals to a corresponding one of the terminations to form thermally conductive contact between the terminals and the terminations.

26. The method of claim 25, wherein the formed thermally conductive contact between the terminals and the terminations is also electrically conductive.

* * * * *